United States Patent [19]

Leu

[11] Patent Number: 4,565,130

[45] Date of Patent: Jan. 21, 1986

[54] APPARATUS FOR PRODUCING STACKS OF PRINTED PRODUCTS PROVIDED WITH A COVER SHEET

[75] Inventor: Willy Leu, Pfäffikon, Switzerland

[73] Assignee: Ferag AG, Hinwil, Switzerland

[21] Appl. No.: 673,021

[22] Filed: Nov. 19, 1984

[30] Foreign Application Priority Data

Nov. 30, 1983 [CH] Switzerland ..... 6395/83

[51] Int. Cl.[4] ..... B41F 13/64

[52] U.S. Cl. ..... 101/240; 270/58; 271/297; 271/299

[58] Field of Search ..... 101/238–241; 270/58, 95; 271/90, 93, 226, 279, 297–299

[56] References Cited

U.S. PATENT DOCUMENTS

| | | | |
|---|---|---|---|
| 1,935,051 | 11/1933 | Harrold | 101/240 X |
| 2,067,404 | 1/1937 | Marchev | 101/240 |
| 3,895,574 | 7/1975 | Nyborg | 101/240 X |
| 4,210,078 | 7/1980 | Greiner et al. | 101/240 X |
| 4,269,401 | 5/1981 | Sargis | 270/58 |
| 4,318,539 | 3/1982 | Lamos | 270/58 |
| 4,331,327 | 5/1982 | Felix | 270/58 |

FOREIGN PATENT DOCUMENTS 3006936 8/1980 Fed. Rep. of Germany ..... 101/240

OTHER PUBLICATIONS

"A Pneumatically Actuated Sorting Apparatus", Xe Disclosure Journal, vol. 5, No. 6, Nov./Dec. 1980, pp. 613–614.

*Primary Examiner*—E. H. Eickholt

*Attorney, Agent, or Firm*—Werner W. Kleeman

[57] ABSTRACT

A stacking device having at least two stacking wells supplied from above is arranged subsequent to a delivery conveyor for printed products. A deposition apparatus for depositing one cover sheet on each completed stack is also provided. In order not to have to deposit this cover sheet upon the stack just as it leaves the stacking device, a device for preparing individual pre-printed cover sheets is provided. The deposition apparatus includes a cover sheet conveyor arranged subsequent to this cover sheet preparing device. The cover sheet conveyor is provided with a controllable outlet for each stacking well and opens into its associated stacking well.

10 Claims, 11 Drawing Figures

APPARATUS FOR PRODUCING STACKS OF PRINTED PRODUCTS PROVIDED WITH A COVER SHEET

BACKGROUND OF THE INVENTION

The present invention broadly relates to stacking devices and, more specifically, pertains to a new and improved construction of an apparatus for producing stacks of printed products provided with a cover sheet.

Generally speaking, the apparatus of the present invention comprises a delivery conveyor for supplying printed products, a stacker arranged subsequent to the delivery conveyor and having at least two stacking wells or chutes individually supplied from above and deposition means for depositing one cover sheet on each produced stack.

Shipment of printed products, for instance newspapers, from the printing plant to large distribution centers is usually done in stacks. It is usual to provide each stack with a cover sheet upon which, for instance, the address of the distribution center and the number of copies included in the stack are indicated.

These cover sheets were heretofore either deposited manually upon the stack as it left the stacker or else so-called depositors were proposed which removed one cover sheet from a prepared packet of such cover sheets and deposited it upon the upper side of the stack as it left the stacker. Manual deposition is not able to keep up with the production capacity of modern stackers which, in turn, are adapted to the production capacity of modern rotary printing presses or rotogravure machines. The employment of depositors entails the disadvantage that the stack leaving the stacker must be temporarily halted in order that the cover sheet can be deposited thereupon, whereupon the stack must be again set in motion. This is detrimental to the stability of the stack since the stack is not yet tied or stabilized by other wrapping means. Furthermore, the outlets of the depositor must be adapted to the varying heights of the stacks leaving the stacker, which requires corresponding mechanical equipment expenditure.

In modern stackers, which—as already mentioned—are able to accommodate the continuous and high production capacity of rotary printing presses or rotogravure machines, two or more stacking spaces—also called stacking wells or clutes—are provided and are alternatingly supplied by a delivery conveyor. If the heretofore known depositors were employed in such stackers, then one depositor per stacking well would have to be provided which, quite apart from increased mechanical equipmebnt expenditure, would require more space.

SUMMARY OF THE INVENTION

Therefore, with the foregoing in mind, it is a primary object of the present invention to provide a new and improved construction of an apparatus for producing stacks of printed products provided with a cover sheet which does not exhibit the aforementioned drawbacks and shortcomings of the prior art constructions.

Another and more specific object of the present invention aims at providing a new and improved construction of an apparatus of the previously mentioned type which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the apparatus or equipment of the present invention is manifested by the features that the deposition apparatus or means includes a device for preparing individual printed cover sheets and a cover sheet conveyor arranged subsequent thereto, the cover sheet conveyor being provided with a controllable outlet for each of the stacking wells and each controllable outlet opening into its associated stacking well.

In the stacking apparatus of the invention, the cover sheets therefore arrive directly in the stacking well, i.e. before the completed stack situated therein is set in motion for discharge. In other words, according to the invention the stack is already provided with a cover sheet before the stack is discharged from the associated stacking well, respectively before it is transported away.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
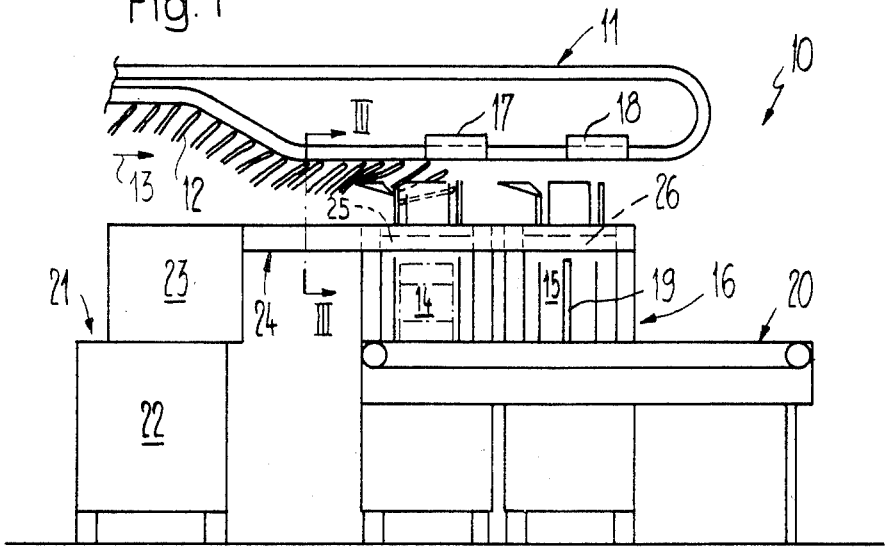
FIG. 1 schematically shows a side view of an apparatus according to the invention.

Describing now the drawings, it is to be understood that to simplify the showing thereof only enough of the structure of the apparatus for producing stacks of printed products each provided with a cover sheet has been illustrated therein as is needed to enable one skilled in the art to readily understand the underlying principles and concepts of this invention. Turning now specifically to FIG. 1 of the drawings, the stacking apparatus 10 illustrated therein by way of example and not limitation will be seen to comprise a schematically indicated end section of a printed product delivery conveyor 11 which is provided with suitable, conventional, and therefore not particularly shown, controlled grippers arranged in mutual spaced relationship which each deliver one printed product 12 in the direction of the arrow 13 to each of two stacking wells or chutes 14 and 15 of a stacking device or stacker generally indicated with the reference numeral 16. Alternatingly activated release stations which bring the grippers into the open position either above the stacking well 14 or the stacking well 15 and thereby release the printed products to freely fall into the corresponding stacking well 14 or 15 are only schematically illustrated and are generally designated with the reference numerals 17 and 18, respectively. Further details concerning the delivery conveyor 11 and the stacker 16 can, for instance, be found in the German Patent Publication No. 3,130,945, published Apr. 29, 1982, even though only one stacking well of a stacker is shown.

Figure 2:
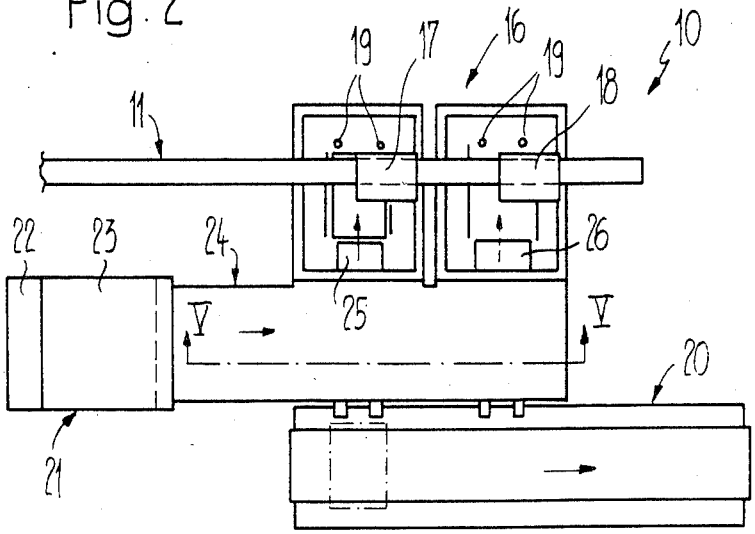
FIG. 2 schematically shows a plan view of the apparatus according to FIG. 1.
Figure 3:
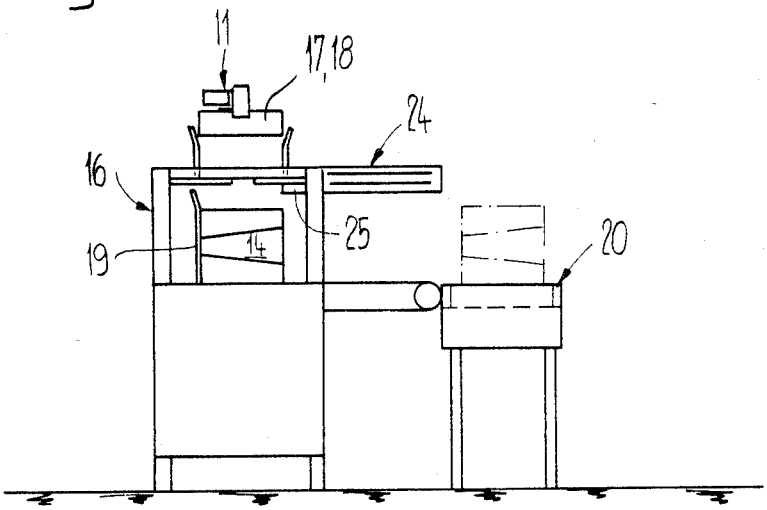
FIG. 3 schematically shows a section taken along the line III—III of FIG. 1.
Figure 4:
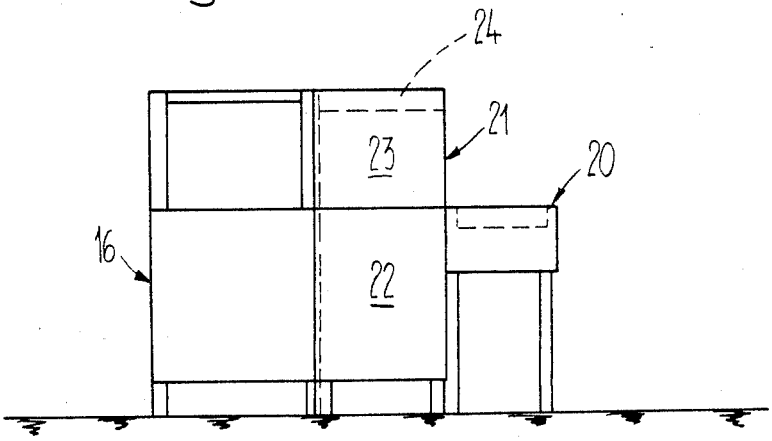
FIG. 4 schematically shows an end view of the left-hand side of the apparatus of FIG. 1 omitting the end section of the printed product delivery conveyor.
Figure 8:
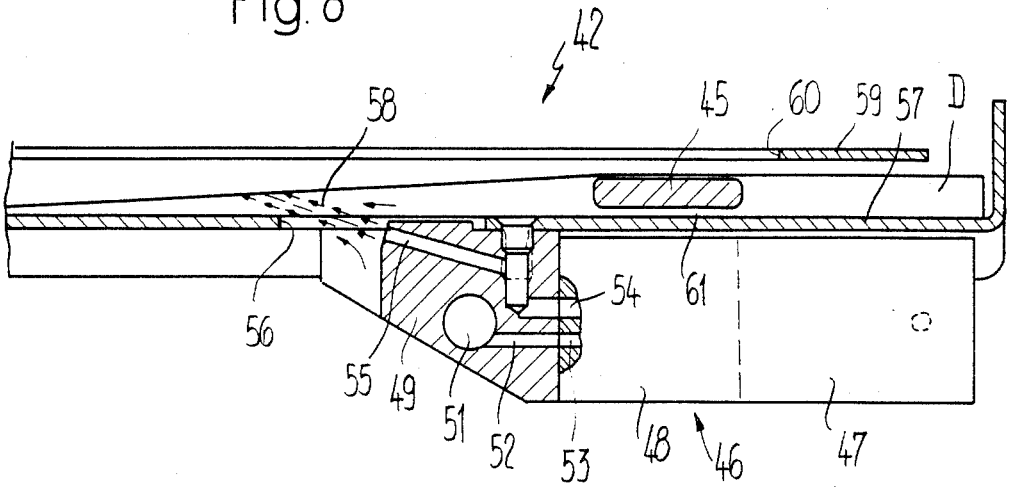
FIG. 8 schematically shows a section taken along the line VIII—VIII of FIG. 6 or FIG. 7 through a portion of one of the discharge stations of the cover sheet conveyor on an enlarged scale.

The stacker 16 is provided with discharge rams or pushers 19 which transfer a stack completely formed in one of the stacking wells or chutes 14 or 15 in a direction perpendicular to the plane of the drawing in FIG. 1, i.e. toward the observer, and directed downwardly in FIG. 2 out of the stacking well 14 or 15 onto a discharge conveyor here schematically shown as a discharge conveyor belt 20. A device 21 for readying or preparing individual and pre-printed cover sheets D which are not particularly shown in FIG. 1 but depicted in FIG. 8, is associated with the stacker 16. This preparation device 21 comprises a conventional computer-controlled fanfold or endless paper printer 22. A conventional cutter device 23 is arranged subsequent to the endless paper printer 22 of the preparation device 21. The fanfold or endless paper printer 22 can, for instance, comprise the printer marketed by the United States company Printronix Incorporated and the cutter device 23 can comprise a device marketed by the well-known Swiss company Kern AG, located at Konolfingen/Bern, Switzerland. A detailed description of the commercially available printer 22 and the commercially available cutter device 23 is therefore not here necessary.

The fanfold or endless paper printer 22 need not be fixedly coupled to the cutter device 23. A central fanfold or endless paper printer can also be provided having a printing capacity sufficient to supply endless or fanfolded printed output for the cutter devices 23 of several apparatus 10. In this case, the cutter device 23 alone constitutes a device for readying or preparing individual and pre-printed cover sheets.

A cover sheet conveyor 24 is arranged subsequent to the outlet of the cutter device 23 and will be described in detail in relation to FIGS. 5 through 9, 10 and 11. This cover sheet conveyor 24 comprises one individually controllable discharge station for each of the stacking wells 14 and 15. An outlet 25, respectively 26, of each discharge station opens lateraly into the stacking well 14, respectively 15, at the level of its upper end.

Figure 5:
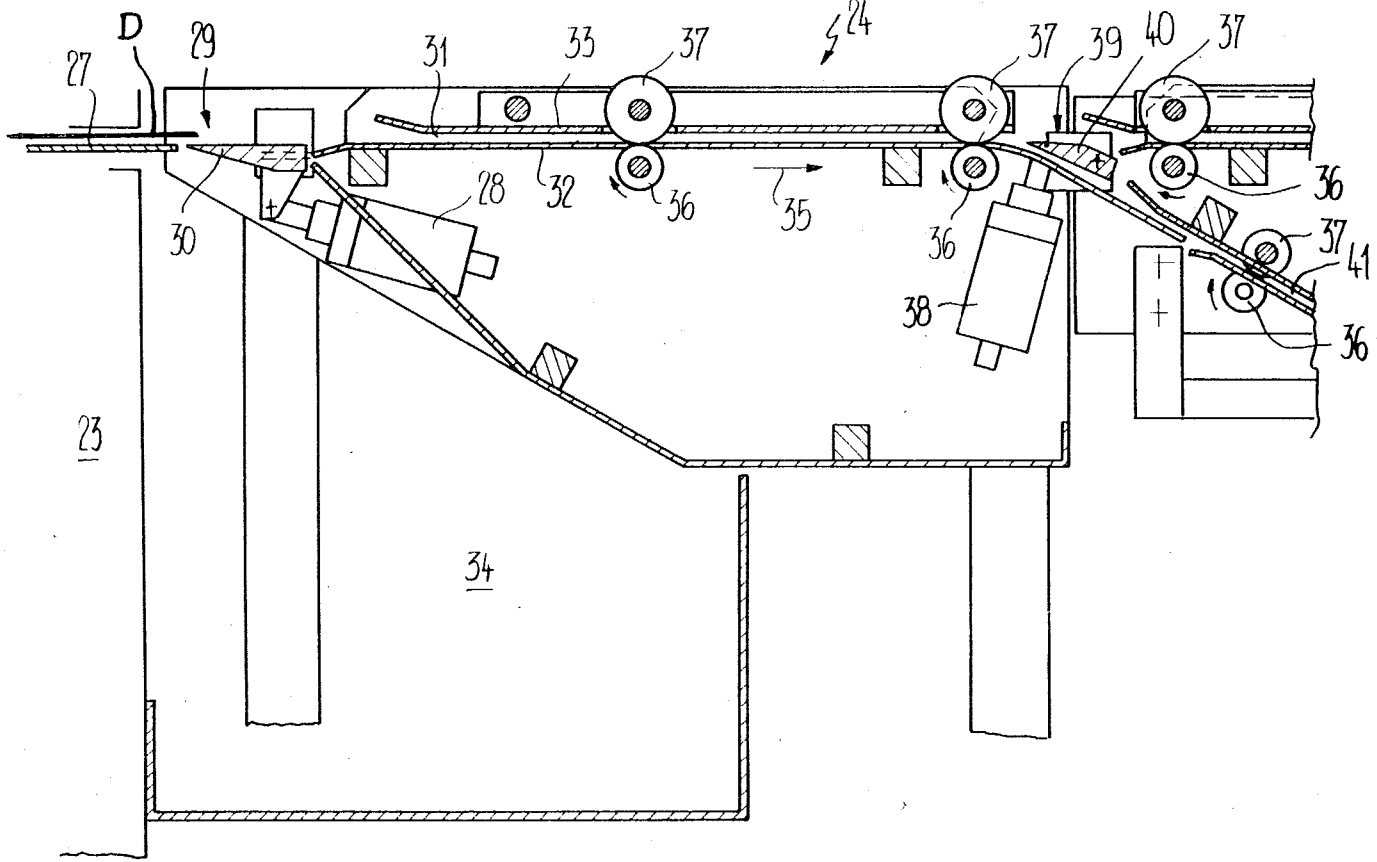
FIG. 5 schematically shows a section taken along the line V—V of FIG. 2 through a section of the cover sheet conveyor subsequent to a cover sheet cutter device.
Figure 6:
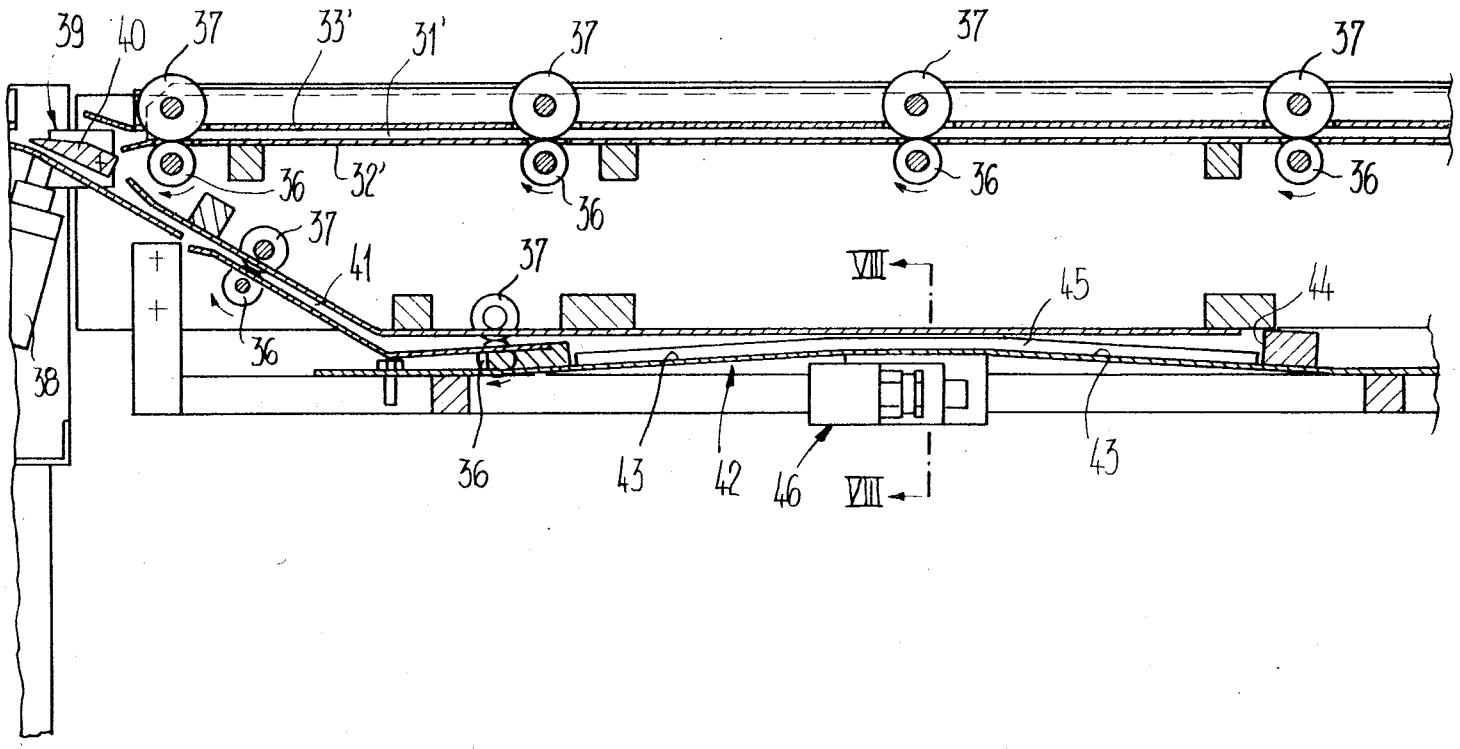
FIG. 6 schematically shows a section taken along the line V—V of FIG. 2 through the section of the cover sheet conveyor lying in the region of the first stacking well.
Figure 7:
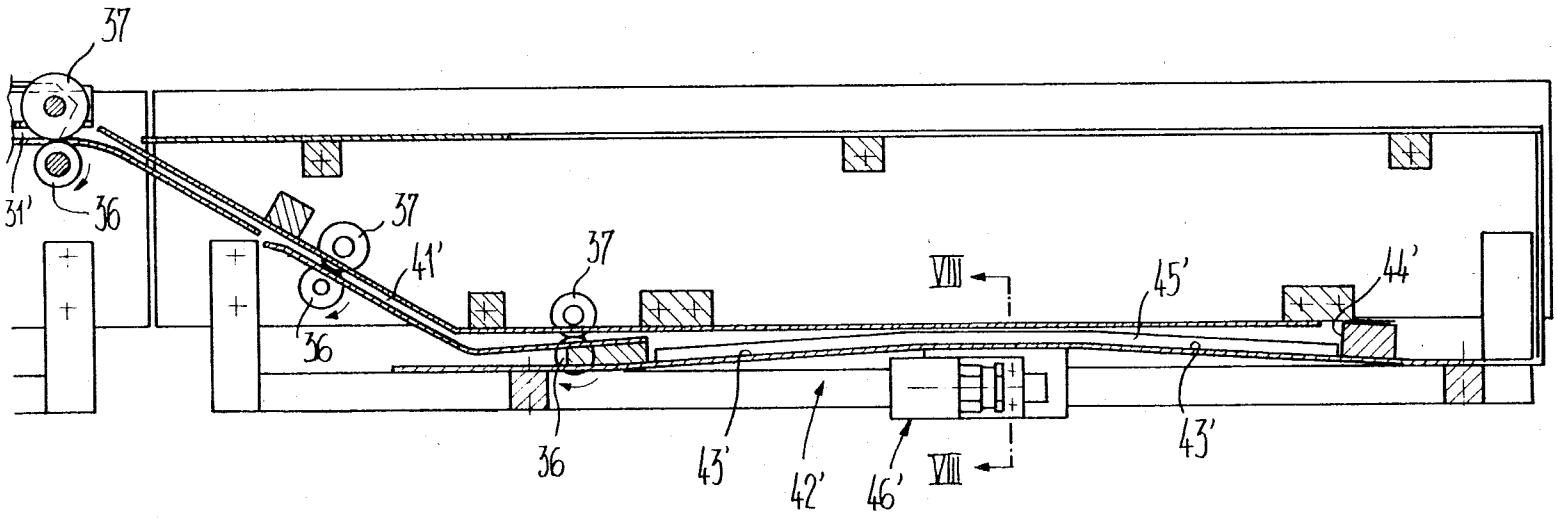
FIG. 7 schematically shows a section taken along the lie V—V of FIG. 2 through the section of the cover sheet conveyor lying in the region of the second stacking well.

FIGS. 5 through 7 show details of the cover sheet conveyor 24. A diverting gate or switch 29 having a switch point or tongue 30 is arranged immediately subsequent to an outlet 27 of the cutter device 23 and is operated by an electromagnet or solenoid 28. If the switch point 30 is in the position shown in full lines in FIG. 5, it conducts the cover sheet D arriving from the outlet 27 into a subsequently arranged conveying channel 31 which is bounded at its lower side by a slide panel 32 and at its upper side by a cover panel 33. If the switch point 30 is, in contrast, in the clockwise upwardly pivoted position, then it guides or diverts the material arriving from the outlet 27 into a waste container 34.

The diverting gate or switch 29 is provided in the present case for the following reasons. The dimension in the output direction of the individual cover sheets D printed by the printer 22 is determined by the fold spacing of the fanfold or endless paper strip. This dimension does not, however, necessarily correspond to the dimension of the cover sheet format measured in the direction of the arrow 35 which is suitable for a stack of printed products. Therefore the cutter device 23 is arranged to cut arriving preprinted cover sheets to a dimension in the output direction of the fanfold or endless paper sheet which is less than the dimension between two subsequent folds of the fanfold paper, i.e. to execute two cuts per sheet of the fanfold or endless paper. The resulting waste strip is not required and is conducted to the waste container 34.

Transport rollers 36 protruding through the slide panel 32 and continuously driven in the direction of the arrow are associated with the conveying channel 31. The transport rollers 36 each cooperate with freely rotatable pressure counter-rollers 37 elastically preloaded against the transport rollers 36 in order to provide a sure feed of the cover sheet being conducted by the switch point 30 into the conveying channel 31.

As can be seen in the right-hand portion of FIG. 5 and in the left-hand portion of FIG. 6, a further diverting gate or switch 39 having a switch point or tongue 40 and operated by an electromagnet or solenoid 38 is installed in the conveying channel 31. If the switch point 40 is in the position shown in full lines in FIGS. 5 and 6, it conducts the cover sheets arriving from the conveying channel 31 into the continuation or extension 31' of the conveying channel 31 which is also bounded at its underside by a slide panel 32' and at its upper side by a cover panel 33'. The slide panel 32' is also provided with a set of transport rollers 36 protruding therethrough in uniform spaced relationship and continuously driven in the direction of the arrow and which—as shown in FIG. 5—cooperate with suitably arranged freely rotatable pressure counter-rollers 37. The transport rollers 36 and the pressure counter-rollers 37 ensure that the cover sheets guided by the switch point 40 into the conveying channel 31' are further conveyed therein.

If the switch point 40 is, in contrast, pivoted upwardly in clockwise direction by the electromagnet or solenoid 38, the not particularly shown cover sheet arriving from the conveying channel 31 is diverted through a channel section 41 branching off downwardly from the conveying channel 31, into which a transport roller 36 and a freely rotatable pressure counter-roller 37 also protrude, into a discharge station 42. This is—as already mentioned—associated with the stacking well 14 and arranged at the level of the upper edge of the stacking well 14. In this discharge station 42 the arriving cover sheet is fed by a further roller pair comprising a transport roller 36 and a pressure counter-roller 37 until it disengages from this roller pair and then slides further by its own inertia over a slightly rising and then descending ramp 43 until it impinges against a stop or abutment 44.

In the region of the lateral edge of the ramp 43 more remote from the stacking well 14, i.e. closer to the observer in FIG. 6, a bar or strip 45 having the form of the ramp 43 (cf. FIG. 8) is arranged in closely spaced relationship thereto to raise the corresponding edge of the delivered cover sheet somewhat more than does the ramp 43. An air nozzle arrangement 46 is provided beneath the apex of the ramp 43 and will be described later in relation to FIGS. 8 and 9. It suffices to mention here that the air nozzle arrangement 46 serves to blow a cover sheet having arrived from the direction of the conveying channel 31 into the discharge station 42 against the stop 44 transversely to this direction through the outlet 25 (cf. FIG. 2) onto a stack situated in the stacking well 14 by a charge of pressurized air.

FIG. 7 principally shows the discharge station 42' associated with the stacking well 15 and which corresponds to the discharge station 42 of FIG. 6, with the exception that the channel section 41' leading to the output station 42' is directly connected to the conveying channel 31, i.e. without a diverting gate or switch. Since only two stacking wells 14 and 15 are present and therefore only two discharge stations are required, no diverting gate or switch is necessary at this point. If three stacking wells were provided, the channel section 41' would branch off from the conveying channel 31' through a further diverting gate or switch, while the conveying channel 31' would continue above the discharge station 42'.

Figure 9:
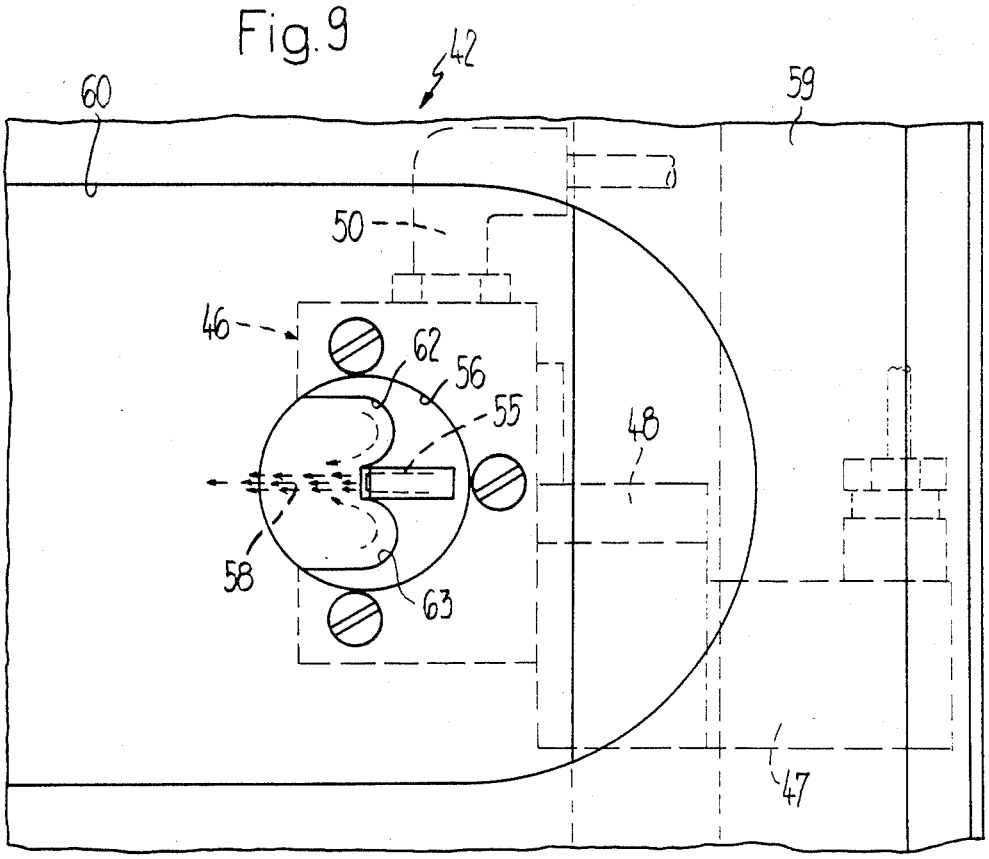
FIG. 9 schematically shows a plan view of the discharge station of FIG. 8.

The air nozzle arrangement 46 shown in FIGS. 8 and 9 as a component of the discharge station 42 is identical with the air nozzle arrangement 46' of FIG. 7 and essentially comprises a regulating valve 48 controlled by an electromagnet or solenoid 47 and mounted thereupon. A nozzle block or manifold 49 is flanged to the regulating valve 48. A supply conduit 50 for compressed or pressurized air is connected to the nozzle block or manifold 49. Apertures 51 and 52 extend from the nozzle block or manifold 49 to an inlet 53 of the regulating valve 48. An outlet 54 of the regulating valve 48 is connected with a nozzle conduit 55 formed in the nozzle block or manifold 49 and whose end section is directed diagonally upward through a circular opening or aperture 56 of a floor or bottom panel 57 of the output station 42 forming the ramp 43 (cf. FIG. 6). Therefore a pulse-like air jet 58 exiting from and in the direction of the nozzle conduit 55 impinges upon the underside of the cover sheet D situated in the discharge station and lying upon the ramp 43, respectively upon the bar or strip 45, and conforming in shape thereto. The cover sheet D is thereby raised from its support and floats to a certain extent upon an air cushion to the stack situated in the associated stacking well or chute.

In order that this transport of the cover sheet by means of a charge of air be performed without interference, the following measures are taken in relation to the discharge station 42 shown in FIGS. 8 and 9. A cover or guide panel 59 extending over the floor or bottom panel 57 forming the ramp has a D or U-shaped section 60 which is either open or extends symmetrically to the nozzle conduit 55. As seen in the direction of the air jet 58, the lateral edges of the cover sheet D shown in FIG. 8 are thereby guided in that they, in contrast to the center region, can only lift off their support surfaces by a limited amount. The pulse-like air jet 48 also has an injector action in that it entrains ambient air with it.

In order that this effect not lead to a temporary underpressure or vacuum between the cover sheet D, on the one hand, and the bottom or floor panel 57 or the bar or strip 45, on the other hand, and the cover sheet D not be retained at its trailing edge (on the right in FIG. 8) by the latter elements, a gap 61 is provided between the bar or strip 45 and the bottom or floor panel 57 through which air can unimpededly enter. The notches or cut-outs 62 and 63 formed in the nozzle or block or manifold 49 and flanking the exit of the nozzle conduit 55 on both sides have an analogous purpose, namely to prevent the arisal of a suction or vacuum induced by the air jet or stream 58 and acting on a portion of the cover sheet D and thereby hindering the discharge of the same from the discharge station.

Figure 10:
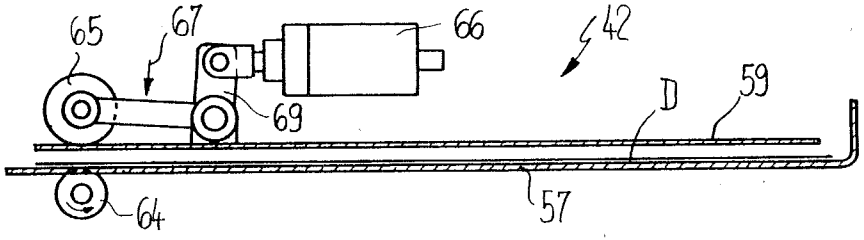
FIG. 10 schematically shows a simplified section through a modified embodiment of one of the discharge stations.
Figure 11:
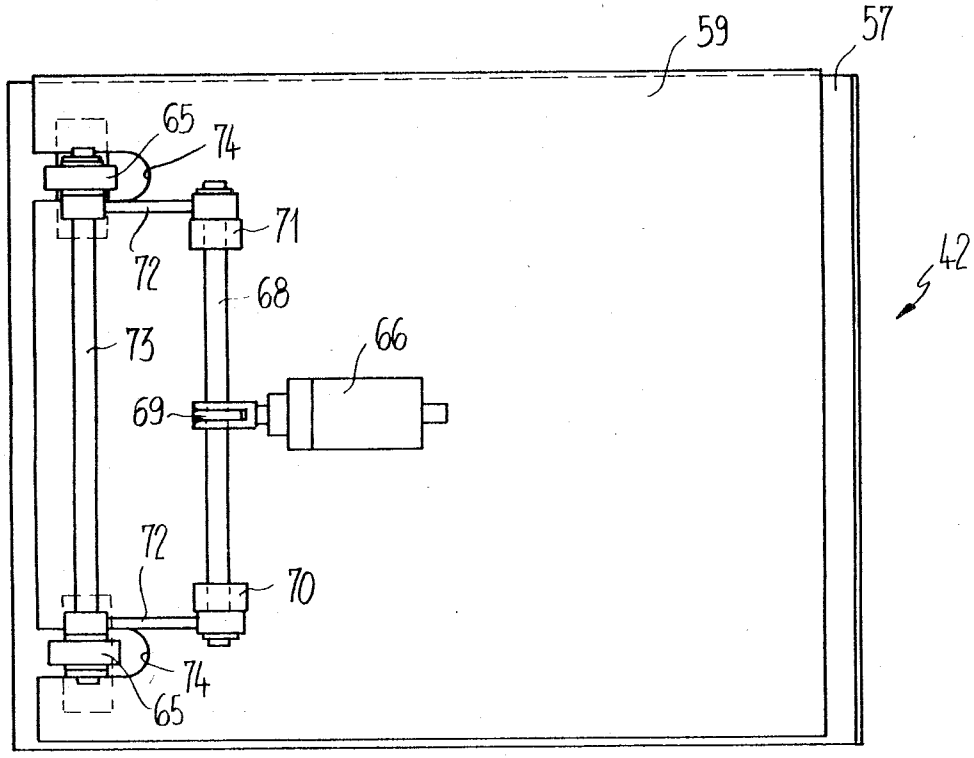
FIG. 11 schematically shows a plan view of the discharge station of FIG. 10.

In the discharge station 42 shown schematically in FIGS. 10 and 11 the discharge of the cover sheet D is performed mechanically by friction drive. The floor or bottom panel 57 is therefore planar, as is the cover panel 59 arranged in spaced relationship thereover. The floor or bottom panel 57 is penetrated in its region nearer its associated stacking well 14 or 15 by transport rollers 64 (in the embodiment illustrated two transport rollers) continuously driven in the direction of the arrow and which cooperate with pressure counter-rollers 65. These pressure counter-rollers 65 can be advanced toward the transport rollers 64 and lifted away from them by means of an electromagnet or solenoid 66 in the direction of the arrow 67. For this purpose the core of the electromagnet or solenoid 66 is hingedly coupled to the free end of a crank arm 69 fixedly mounted on a shaft 68, while protruding arms 72 are anchored on the free ends of the shaft 68 rotatably journalled upon the cover panel 59 at the locations designated by the reference numerals 70 and 71. The protruding arms 72 support journal positions for a shaft 63 interconnecting the two pressure counter-rollers 65. Notches or cut-outs 74 are formed in the cover panel 59 to allow the pressure counter-rollers 65 to protrude through the cover panel 59 as they are advanced toward the transport rollers 64.

The operation of the described apparatus should be readily apparent from the above description. The operationally required selective control of the release stations 17 and 18, of the printer 22 and the cutter device 23, of the diverting gate or switch 39 as well as of the regulating valve 48 or the electromagnet or solenoid 66 at the discharge stations 42 and 42' is transmitted by a suitable, conventional, not particularly shown, preprogrammed copy-counter arranged upon the delivery conveyor 11 preceding the stacker 16. The control commands or signals to the individual components mentioned are transmitted in a temporal sequence and the intervals between the individual control commands or signals depend essentially upon the transport speed of the delivery conveyor 11. The diverting gate or switch 29, on the other hand, is selectively controlled by the cutter device 23 according to the prescribed dimensions of the format adjusted at this cutter device 23.

If it is desired that the cover sheet come to lie undermost on the stack to be formed in the stacking well, the apparatus can also be so constructed that the outlets 25 and 26 open into the stacking wells at the bottom. This would, however, have to occur upon the side opposite the discharge side of the stack from the stacking well.

In any event the described apparatus ensures that the cover sheet, such as a lable or address or data sheet, is delivered to the stack before the latter leaves the stacking well in which it is formed.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for producing stacks of printed products provided with cover sheets, comprising:

delivery conveyor for supplying said printed products;

a stacker arranged in cooperating relationship with respect to said delivery conveyor and having at least two stacking wells individually supplied from above with the printed products;

deposition means for depositing one cover sheet on each stack produced;

a device for readying individual printed cover sheets;

said deposition means including a cover sheet conveyor arranged subsequent to said device for readying cover sheets;

said cover sheet conveyor being provided with a controllable discharge outlet for each stacking well of said at least two stacking wells; and each said controllable discharge outlet opening into a therewith associated one of said at least two stacking wells.

2. The apparatus as defined in claim 1, wherein:

said device for readying said individual printed cover sheets comprises a printer for endless paper and a cutter device arranged subsequent to said printer.

3. The apparatus as defined in claim 1, wherein:

said cover sheet conveyor runs substantially parallel to said delivery conveyor; and said cover sheet conveyor being provided with a discharge station for each stacking well of said at least two stacking wells.

4. The apparatus as defined in claim 3, wherein:

said individual printed cover sheets have a conveying direction; and each said discharge station being provided with means for transporting an individual printed cover sheet situated in said discharge station in a direction transverse to said conveying direction into an associated one of said at least two stacking wells.

5. The apparatus as defined in claim 3, wherein:

each said controllable discharge outlet of each said discharge station being situated at the level of an upper end of an associated one of said at least two stacking wells.

6. The apparatus as defined in claim 4, wherein:

said cover sheet conveyor includes a conveying channel;

supply channels branching off said conveying channel to each of said discharge stations;

diverting gates connecting at least one of said supply channels with said conveying channel; and a supply channel arranged last in said conveying direction being devoid of a diverting gate.

7. The apparatus as defined in claim 4, wherein:

said means for transporting said individual printed cover sheet situated in said discharge station into said associated one of said at least two stacking wells includes an air nozzle for producing a charge of pressurized air directed to said associated one of said at least two stacking wells and directed at an underside of said individual printed cover sheet.

8. The apparatus as defined in claim 7, wherein:

said air nozzles have an outlet; and each said discharge station including guide elements for raising an arriving individual printed cover sheet above said outlet of said air nozzles.

9. The apparatus as defined in claim 4, wherein:

said means for transporting said individual printed cover sheet situated in said discharge station into said associated one of said at least two stacking wells includes at least one selectively intermittently conveyingly effective roll pair; and said roll pair acting directly upon said individual printed cover sheet.

10. The apparatus as defined in claim 3, wherein:

said cover sheet conveyor has a first conveying direction;

said delivery conveyor having a second conveying direction; and said first and second conveying directions extending essentially parallel to one another.

* * * * *